US005924160A

United States Patent [19]

Bradley

[11] Patent Number: 5,924,160

[45] Date of Patent: Jul. 20, 1999

[54] GLOVE AND WASH CLOTH

[76] Inventor: Jocelyn D. Bradley, 37 E. 55th St., Brooklyn, N.Y. 11203

[21] Appl. No.: 08/248,160

[22] Filed: May 24, 1994

[51] Int. Cl.[6] ..... A47L 13/18

[52] U.S. Cl. ..... 15/227; 428/34.1; 428/36.1

[58] Field of Search ..... 15/227, 229.11; 428/34.1, 36.1; 2/159, 160, 161.6, 161.8, 167

[56] References Cited

U.S. PATENT DOCUMENTS

| | | | |
|---|---|---|---|
| 1,528,026 | 3/1925 | Pease | 15/227 |
| 1,882,588 | 10/1932 | Heath | 154/227 |
| 2,668,309 | 2/1954 | Suttles | 15/227 |
| 2,795,806 | 6/1957 | Suttles | 15/227 |
| 4,523,348 | 6/1985 | Petrie | 15/227 |
| 4,797,967 | 1/1989 | Lengers | 15/227 |
| 4,964,188 | 10/1990 | Olson | 15/227 |

*Primary Examiner*—Ellis P. Robinson
*Assistant Examiner*—Rena L. Dye

[57] ABSTRACT

An article for cleaning, washing and scrubbing comprising of a three layered cloth glove, useable on either the right or the left hand. The middle layer of the glove divides the palm and finger sections of the glove into right and left handed glove sections. Attached to the entire width of the wrist edge of the middle layer of said glove is the stem end of a pear shaped wash cloth. Said attachment of glove and wash cloth continues down the outer seam of the thumb of the glove, that is, from the wrist to the seam of the thumb.

6 Claims, 3 Drawing Sheets

GLOVE AND WASH CLOTH

BACKGROUND OF THE INVENTION

The present invention relates to an instrument for use in washing, cleaning, dusting and polishing of soiled surfaces and objects. More particularly, the invention relates to a combination glove and wash cloth which can be used to clean the body or to perform personal chores such as washing, cleaning and dusting in the home, office, factory or elsewhere.

At present, the materials used to effect cleaning and washing of the body, cleaning the furniture or wiping up spills around the home, office, factory and elsewhere, consists of a variety of absorbent materials including paper and cloth towels, wash cloths, mittens, gloves or rags of all sorts. In order to effect proper cleaning, it is generally preferable to use the mentioned items together i.e. it is preferable to place a glove or mitten on the hand then use the absorbent cloth material to do the actual cleaning, wiping, etc.

This combined usage is necessary since, in general, the commonly used glove like devices have a small surface area for wiping, cleaning or scrubbing and are therefore not an effective cleaning tool. Moreover, because most of the cleaning materials contain caustic substances and materials which can cause harm to the hand and fingers, the combination glove and cloth have become an indispensable tool. Generally, the cleaning cloths are folded or wrapped in some way to avoid contact between the cleaning material or detergent and the user's hands and fingers. This need to fold or wrap the cleaning cloth is self defeating since the folding or wrapping diminishes the cleaning surface.

When mittens are used to cover the hand, they, because of their shape, inhibit the users ability to grasp objects while in use. For this reason, they cannot be used to clean items which have a small surface area, objects which have narrow openings or areas which are not clearly visible.

Thus, it is a primary object of this invention to provide a glove like device which is capable of being used to accommodate the fingers and thumb of either the left hand or the right hand, and to which is attached a piece of absorbent cloth material to form a useful device for performing cleaning, washing, scrubbing and wiping of the body or other objects.

A further object of this invention is to provide a cleaning glove which will overcome the problems mentioned in the prior art, in particular, the problem of protecting the hands and fingers from being damaged or contaminated by the detergent or other cleaning substance in used in the process.

Another object of this invention is to provide a glove having a cleaning cloth attached to the glove to provide a large surface for cleaning, washing, wiping and scrubbing.

Still another object of this invention is to provide a cleaning device which is capable of being used alternatively on the right hand or left hand as the need arises.

Yet another object of this invention to provide a glove with a cleaning cloth to which soap, detergent or any other cleaning materials may be applied so that the users hand may not be contaminated by the cleaning materials. This is particularly important to many individuals who maintain longer finger nails or regularly incur infections in the tender regions of the finger around the nails. These individuals will find this device most useful because it will permit them to do their personal cleaning, and house work while protecting the nails from damage.

SUMMARY OF THE INVENTION

The object of this invention is to provide a cleaning apparatus which is capable of protecting the hands, and in particular the nails of the female hands from damage to itself as well as from damaging other parts of the body.

This cleaning apparatus consists of a combined three layered glove and a pear shaped wash cloth, which are made from an absorbent cloth material. The three layered glove includes a palm and five finger engaging pockets separated from each other by means of a cloth divider which divides the palm of the glove and the finger engaging pockets into five identical right handed finger engaging pockets and five left handed finger engaging pockets.

The structure of the palm and appended finger engaging pockets is identical with the physical structure of a human hand, in that there is a distinct pocket for each finger and a thumb. One unique feature of the glove is that the engaging pockets on either side of the middle divider are identical in shape and form to the other, however, the make-up is such that the fingers of the right hand engaging pocket cannot fit comfortably into the fingers of the left hand engaging pocket.

A pear shaped wash cloth is attached to the glove along the outside seam of the thumb side of the glove and to the middle layer at the wrist. As a result of this arrangement either side of the glove can be used for scrubbing, thus, the palm side of the glove alternates to coincide with the use of the glove on the right or left hand. To switch from left handed to right handed use it is only necessary to insert the left or right hand into the appropriate finger engaging pocket and flip the wash cloth from one side of the glove to the other. In this way the glove can be used interchangeably on either the left or the right hand without any difficulty.

When the glove is used on the right hand, the user's right hand is inserted into the right side finger engaging pocket and the wash cloth is positioned on the front, palm side of the glove, that is, the side being used in scrubbing or cleaning. To use the glove on the left hand, one has to employ the reverse process, that is, the left hand is inserted into the left side finger engaging pocket and the wash-cloth flipped over to the front, palm side of the glove.

In accordance with the invention, there is described a glove, which can be interchangeably, worn and used on either hand to which is attached a washing or cleaning cloth which will improve all phases of the cleaning process whether in industry, in the home, office, or business place. The glove will also enhance the washing or scrubbing of the human body, and will be particularly helpful in cleaning the aged, the bedridden and the infirm and shorten the time in which these tasks can be carried out.

The glove of this invention is superior to a regular glove because appended to it is a larger scrubbing surface. One advantage of the cloth is that cleaning materials can be applied to the cloth before attempting to perform the task at hand. This is useful in situations where the user needs one hand as a means of supporting oneself, an object or an aged or infirm person during the cleaning process.

The glove of this invention is also superior to a mitten because it will leave one hand free to grasp and hold objects while being used.

Moreover, in hospitals, nursing homes and in other places where aged patients have to be cared for and cleaned by nurses or other health aides, it is common to require two or more persons to effectively care for and clean a patient who is unable to help themselves or to stand during cleaning. This invention will allow one person to do the job. By virtue of the invention, one hand can always remain free to hold or help the sick person to stand-up during cleaning. The soap or other cleaning material can be applied to the cloth surface before the patient is prepared for cleaning.

In practice, the cleaning cloth is held in the palm of the hand and extends beyond the fingers of the hand. During the cleaning or wiping process, the cloth portion of the glove can be formed into a padlike surface to more readily facilitate the cleaning or scrubbing process.

Other benefits to be derived from the use of the glove of this invention, include two handed washing which is made possible by wearing the glove of this invention on either hand. Thus, when cleaning needs to be done in difficult areas, the glove can be exchanged without the user having to move or change position in order to continue cleaning. Further, with the larger surface provided, it is possible to expedite the cleaning process and to clean larger areas quickly. Moreover, since the glove can be made of any absorbent soft and durable material, it can be produced cheaply and quickly.

BRIEF DESCRIPTION OF THE DRAWINGS

This object and other objects of the invention should be discerned and appreciated from the detailed description taken in conjunction with the drawings in which.

Figure 1:
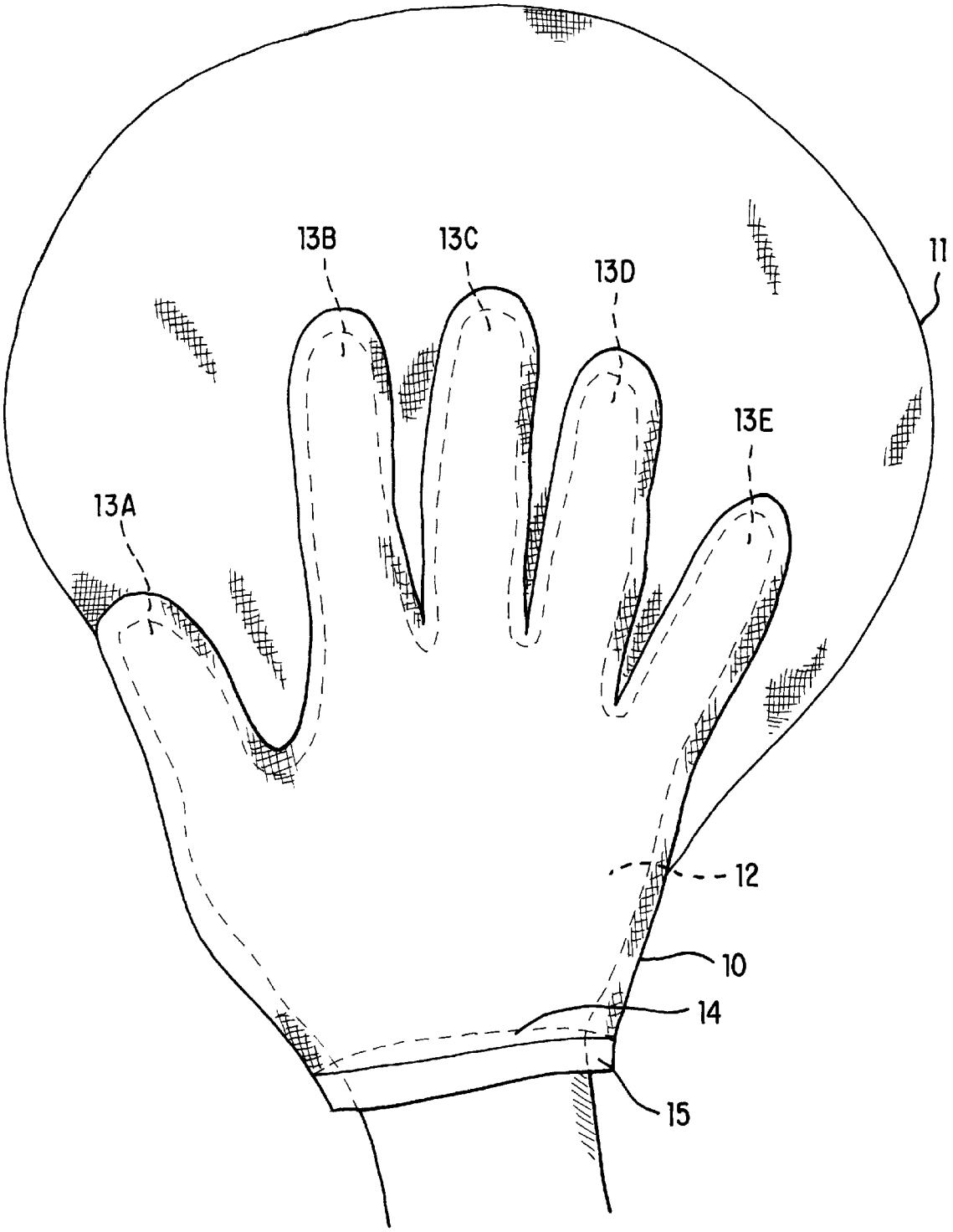
FIG. 1 shows a flat section of the glove of the invention with a right hand inserted.

In the drawing FIG. 1 generally refers to the invention of the glove that can be interchangeably used and worn on either hand. As shown, the glove 10 and cleaning cloth 11 are shown as worn on the hand.

In a preferred embodiment of this invention, the glove and cleaning cloths are made of terry cloth or similar absorbent material.

The glove (10) of the invention is made to accommodate the palm (12) and fingers (13a–e) of either hand in an enclosed manner. One side of the glove is made to accommodate a right hand thumb and fingers and the other side a left hand thumb and fingers. The left and right sides of the glove are brought together on each other and laid flat so that the palm side of the left hand glove faces the palm side of the right hand glove. The two sides are separated by a layer of cloth material (15) sewn between the gloves. This cloth divider is attached to the cloth appendage (11) at the wrist (14), So as to divide the palm of the right hand glove from the palm of the left hand glove.

In order to attach the cloth appendage, the glove as formed above is then laid flat and a piece of cloth or other absorbent material is cut in a pear shaped form such that the narrower portion of the pear is equal in size to the wrist portion of the glove. This end of the pear shaped cloth is then sewn to the wrist end portion of the glove divider which, in practice, serves to divide the glove into its right handed and left handed sections. The edge of the wash cloth on the thumb side of the glove is then sewn onto the outer seam of the thumb thereby forming and unbroken seam between the wrist of the glove divider and the thumb of the glove.

In practice, the cleaning cloth is held in the palm of the hand and extends beyond the fingers of the hand. During the cleaning or wiping process, the cloth portion of the glove can be formed into a padlike surface to more readily facilitate the cleaning or scrubbing process. Soap or other cleaning materials is applied to the surface of the side of the wash cloth prior to performing any scrubbing or cleaning. When the glove is changed from the right hand use to a left hand use, the cleaning cloth is flipped from side to side to facilitate the change in cleaning position.

Other benefits to be derived from the use of the glove of this invention, include two handed washing which is made possible by wearing the glove of this invention, include two handed washing which is made possible by wearing the glove of this invention on with either hand. Thus, when cleaning needs to be done in difficult areas, the glove can be exchanged without the user having to move or change position in order to continue cleaning. Further, with the larger surface provided, it is possible to expedite the cleaning process and to clean larger areas quickly. Moreover, since the glove can be made of any absorbent soft and durable material, it can be produced cheaply and quickly.

BRIEF DESCRIPTION OF THE DRAWINGS

This object and other objects of the invention should be discerned and appreciated from the detailed description taken in conjunction with the drawings in which:

FIG. 1 shows a cut out section of the glove of the invention with a right hand inserted palm downwards and showing the glove and cloth in position for wiping, cleaning or scrubbing.

Figure 2:
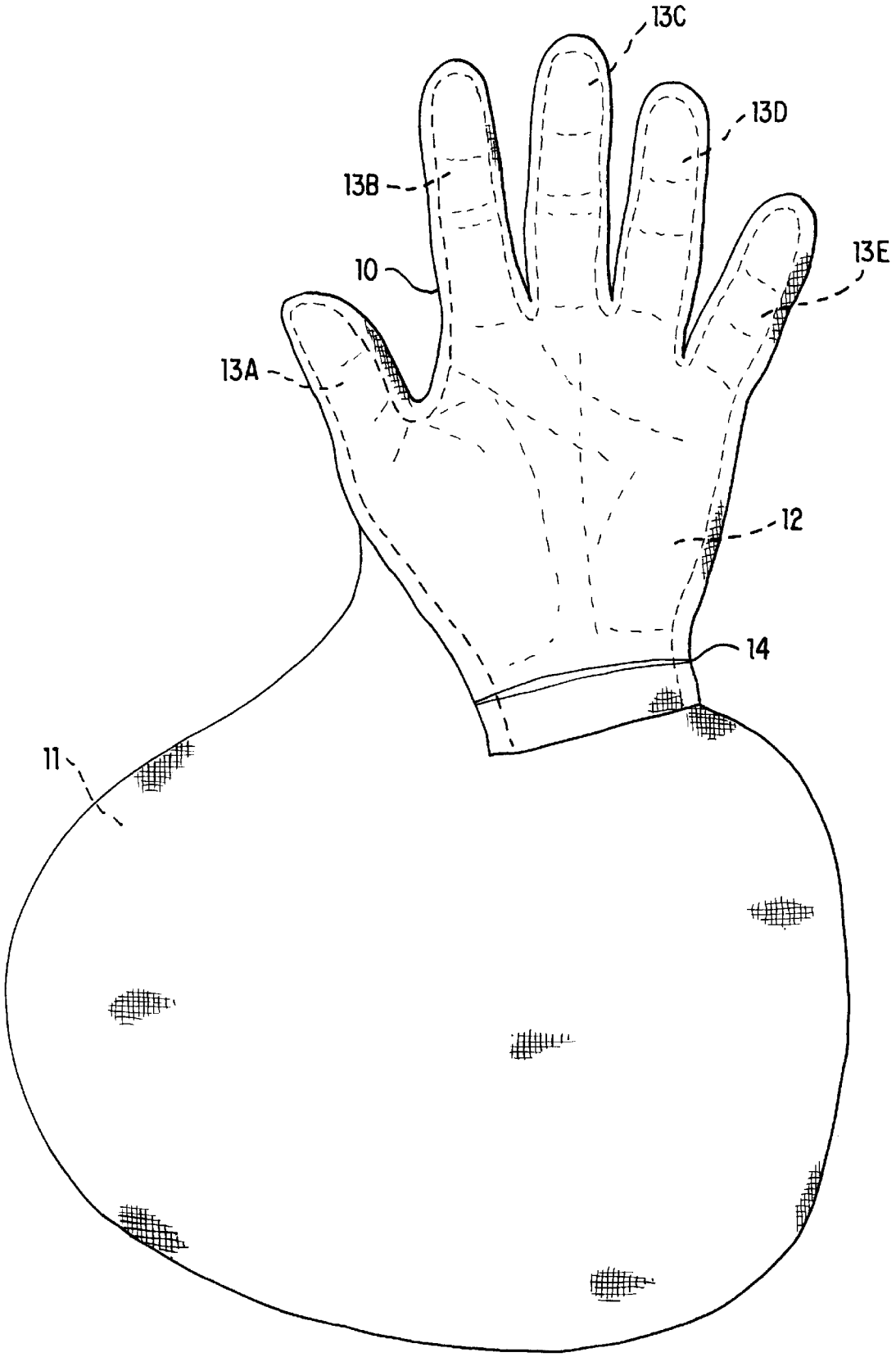
FIG. 2 shows a flat section of the glove of the invention with a left hand inserted palm upwards with the cloth extended.
Figure 3:
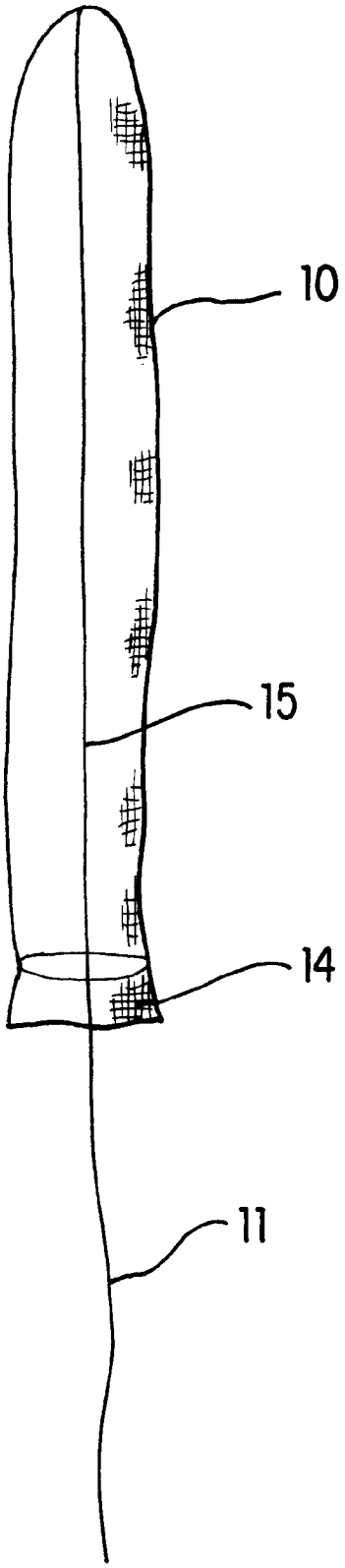
FIG. 3 shows a side view of the glove of the invention showing the two glove section separated by the cloth divider means.

FIG. 2 shows a section of the glove of the invention with the cloth appendage connected to the edge of the thumb and the index finger of the right hand palm portion of the glove. This arrangement permits the glove to be flipped over from one side of the glove to the other to permit the glove to be used in cleaning by either left handed or right handed persons. Because of the method of construction of glove, it will find wide usage in cleaning and scrubbing and in a variety of other situations and circumstances. Moreover, if an absorbent material such a terry cloth is used, the value of the glove will be greatly enhanced and its usage will become widespread in the cleaning industry.

The form of the invention shown and described is to be taken as a preferred example of the same and that changes in the size, shape and arrangements of the party may be employed in practical situations without departing from the spirit of the invention or the scope of the appended claims.

What I claim is:

1. A glove and cleaning cloth adaptable for use in cleaning, washing or polishing comprising a three layered two-sided glove having two outer layers separated from each other by a middle layer having appended to it wash a pear shaped cloth, and wherein said outer layers and said middle layer are stitched together such that palm and finger engaging pockets are formed on both sides of said middle layer wherein each of said palm and finger engaging pockets has fingers equal in number to the fingers of one hand and are arranged in form and constructed to imitate the natural physical configuration and contour of the palm and fingers of the human hand and wherein the palm and finger engaging pockets of said glove include right hand palm and finger engaging pockets and left hand palm and finger engaging pockets designed to accommodate the user's palms and fingers so that only the user's right hand and fingers can comfortably be inserted into said right hand and finger engaging pockets and only said left hand and fingers can comfortably be inserted into said left hand and finger engaging pockets and wherein said three layers of the glove including said middle layer and said finger engaging pockets are made from an absorbent cloth material and wherein said middle layer separating said palm and finger engaging pockets are made from an absorbent material which is thinner and lighter in weight than the absorbent material which is used to construct said two outer layers of said glove and wherein said middle layer of said glove is stitched to said wash cloth at the wrist wherein the width of the stem portion of said wash cloth is equal to the width of said middle layer and wherein said wash cloth is also stitched to said glove at the outer seam of the thumb of said glove.

2. A glove and cleaning cloth in accordance with claim 1 wherein said palm and finger engaging pockets are designed so that the only means separating said palm and finger engaging pockets of the right hand from said palm and finger engaging pockets of the left hand is said absorbent cloth material which forms said middle layer of said glove and cleaning cloth.

3. A glove and cleaning cloth as described in claim 1 wherein said right and left palm and finger engaging pockets are separated from each other by means of said absorbent cloth layer such that said right hand palm and finger engaging pockets of said glove and said left hand palm and finger engaging pockets of the glove are separated and divided from the left hand side of said glove comprise separate but connected palm and finger engaging pockets.

4. A glove and cleaning cloth as described in claim 1 wherein the user can change said glove from right handed to left handed use by flipping said cleaning cloth from one side of the glove to the other side.

5. A glove and cleaning cloth as described in claim 1 wherein only the user's right hand and fingers can be inserted comfortably into said right side palm and finger engaging pockets of said glove to permit the user to perform the tasks of scrubbing, cleaning or washing.

6. A glove and cleaning cloth as described in claim 1 wherein only the user's left hand and fingers can be inserted comfortably into said left side palm and finger engaging pockets of said glove to permit the user to perform the tasks of scrubbing, cleaning or washing.

* * * * *